US006325619B2

(12) United States Patent
Dane

(10) Patent No.: US 6,325,619 B2
(45) Date of Patent: Dec. 4, 2001

(54) GAS BURNER WITH MULTIPLE GAS RINGS

(75) Inventor: Bernard Dane, Montbazon (FR)

(73) Assignee: Sourdillon (FR)

( * ) Notice: Subject to any disclaimer, the term of this patent is extended or adjusted under 35 U.S.C. 154(b) by 0 days.

(21) Appl. No.: 09/769,337

(22) Filed: Jan. 26, 2001

(30) Foreign Application Priority Data

Jan. 28, 2000 (FR) ..... 00-01120

(51) Int. Cl.[7] ..... F03D 14/06

(52) U.S. Cl. ..... 431/284; 431/278; 431/354; 431/266; 126/39 E; 126/39 H; 239/562

(58) Field of Search ..... 431/266, 354, 431/278, 284, 10; 126/39 E, 39 R, 39 H; 239/562

(56) References Cited

U.S. PATENT DOCUMENTS

| | | | | |
|---|---|---|---|---|
| 5,277,576 | | 1/1994 | Hartung et al. . | |
| 5,401,164 | * | 3/1995 | Yen | 431/354 |
| 5,842,849 | * | 12/1998 | Huang | 431/284 |

FOREIGN PATENT DOCUMENTS

| | | | | |
|---|---|---|---|---|
| 525299 | * | 2/1993 | (EP) | F23D/14/06 |
| 0534301 | * | 3/1993 | (EP) | F23D/14/00 |
| 0 634 608 A2 | | 1/1995 | (EP) . | |
| 0677705 | * | 10/1995 | (EP) | F23D/14/06 |
| 0 926 437 A1 | | 6/1999 | (EP) . | |
| 2 650 369 | | 2/1991 | (FR) . | |
| 57-87516 | * | 6/1982 | (JP) | F23D/13/10 |
| WO-98/12475 | * | 3/1998 | (WO) | F23D/14/06 |
| WO 99/08046 | | 2/1999 | (WO) . | |

* cited by examiner

*Primary Examiner*—Carl D. Price
(74) *Attorney, Agent, or Firm*—Larson & Taylor, PLC

(57) ABSTRACT

A gas burner with multiple gas rings comprising: a burner body (6) mountable underneath a top plate, with a cut-out section, of an appliance and incorporating a first, upwardly directed gas injector (14) and a second gas injector (9) followed by a horizontal tubular Venturi (10) opening into a vertical well (12); an outer burner head (3) seated on the body (6) through the cut-out section and spaced at a distance above the plate and provided with an annular chamber (22) open above the well (12) and having one or two rows of orifices for flames (4,5); and an inner burner head (1) shaped so as to have a radial divergent (37) coaxially supplied by the first injector through a recess located at the center (31) of the head (3), ports being provided in the head (3) so that all the primary air and the secondary air needed to operate the multiple burner arrives from the top of the top plate of the appliance.

9 Claims, 8 Drawing Sheets

GAS BURNER WITH MULTIPLE GAS RINGS

FIELD OF THE INVENTION

The present invention relates to improvements made to gas burners with multiple gas rings, designed to be mounted on a top plate of a cooking appliance, in particular for domestic use, and which comprises a first, central burner having a ring for peripheral flames and at least a second, annular burner surrounding the central burner at a distance therefrom and having at least one gas ring.

Such burners are used when a high heating power is required and/or, in conjunction with respective gas supply devices for central and annular burners, if the heat output needs to be modulated in terms of where and when it is applied (for example in Asian cooking).

DESCRIPTION OF THE PRIOR ART

Multiple ring burners are known which have a central burner with a gas ring and an annular burner with an outer gas ring or with two, respectively inner and outer gas rings.

However, the structure of these burners is not conducive to securing the degree of safety currently sought, particularly when it comes to preventing the flames from extinguishing and also in terms of compactness, in particular vertical.

SUMMARY OF THE INVENTION

Accordingly, the objective of the invention is to propose a multiple-ring gas burner of an improved type, with a structure designed to impart a degree of safety in keeping with modern requirements whilst remaining simple to manufacture and involving a minimum number of component parts, and which additionally is of a relatively low vertical height making it suitable for mounting both on a conventional cooker and on a cooking hob.

To these ends, the invention proposes a burner as outlined above, which is characterised in that it comprises:

- a burner body designed to be fixed to the top plate, on the bottom thereof, and comprising:
  - a first gas inlet and, communicating therewith, a first gas injector, the axis of which is upwardly directed,
  - a second gas inlet and, communicating therewith, a second gas injector having a substantially horizontal axis and disposed facing a convergent-divergent pipe forming a Venturi which extends across at least the greater part of the transverse extension of the burner body, said pipe communicating, at its end opposite the second injector, with a substantially vertical well open at the top;
- an outer burner head supported, by support means inserted in a cut-out section of said top plate, by said burner body, said burner head comprising:
  - a substantially annular chamber provided with passages for flames at least around one side and having an opening in its base disposed facing said substantially vertical well of the burner body,
  - a central region having a central, vertical recess, and
  - ports disposed between said annular chamber and said central region,
  - said support means for the outer burner head being designed so that said burner head is disposed above and at a distance from the top plate, forming in conjunction therewith an annular space surrounding said central region, said support means having lateral recesses providing a communication between said central recess of the central region and said annular space;

- an inner burner head designed to be centrally supported by said outer burner head facing said central recess of the central region, said inner burner head having a central well directed coaxially with the axis of said first gas injector.

Based on the adopted structure, a burner with multiple gas rings is produced in which all the primary air needed to operate the first, central burner and the second, annular burner is delivered respectively to the vicinity of the first and second gas injectors via paths located exclusively above the top plate of the cooking appliance; to this end, the primary air penetrates the annular space defined between the outer burner head and the top plate, passes through the lateral recesses of the support means of the outer burner head and penetrates the burner body, where it is mixed with the jet of gas from the first injector supplying the central burner, whilst additionally passing from said above-mentioned annular space directly via a lateral opening provided for this purpose, towards the inlet of the horizontal convergent-divergent pipe, where it is mixed with the jet of gas from the second injector to supply the outer burner.

Similarly, all the secondary air supplying the flames arrives via the top of the top plate; this secondary air is made up in part of the ambient air surrounding the burners (annular, outer ring of the second burner; central ring of the first burner), and in part by a fraction of the air penetrating the annular space defined by the outer burner head and the top plate, this fraction of air passing via said ports between the two central and annular burners and supplying the flames of the inner ring of the annular burner and, in part, the flames of the central burner.

Accordingly, the multi-ring burner has structural features designed to secure a supply of air, both primary and secondary, such that use of the subjacent parts of the cooking appliance does not affect the flames, even on a low light, in other words, prevents the flames from being extinguished, in particular on a low light, if the door of a subjacent oven is closed violently.

Furthermore, the horizontal Venturi design supplying the outer burner head and the upwardly directed Venturi made partially in a tubular design and partially in a radially horizontal design, as will be explained below, are such that a burner can be made with a relatively low height, suitable for mounting both on a cooker and on a cooking hob.

In a first possible embodiment, which has the advantage of being simple, the central well of the inner burner head is directed substantially vertically and the axis of the first injector is substantially vertical.

However, in another embodiment which is of interest because it provides a significantly longer Venturi and hence more effective mixing of the air and gas, the central well of the inner burner and the first injector substantially coaxial therewith are inclined by approximately 15 to 20° relative to the vertical.

In an example of an embodiment as applied to domestic cooking appliances, the gas burner has a single annular chamber in the outer burner head, which is provided with passages for flames on both sides and the second, annular burner has two gas rings, the burner being of the type with three gas rings.

In one structurally simple embodiment which requires a reduced number of forged parts, the support means of the outer burner head are integral with said outer burner head and are provided in the form of a skirt projecting down below the bottom of said head and a shoulder surrounding the central recess of the central region of said burner head. With the same concern in mind, the annular chamber of the outer burner head may be closed at the top by a removable annular cover placed on the lateral walls of the chamber.

Similarly, in order to provide the first, central burner with a Venturi of sufficient length, the central well of the inner burner head has, for practical purposes, a section which decreases in an upward direction, thereby forming a first, tubular Venturi section, and the top surface of the inner burner head surrounding the top orifice of the central well defines, in conjunction with a removable cover surmounting it, a radial, annular, divergent section forming a second, radial, annular Venturi section.

In one practical embodiment which enables the burner to be readily adapted to commercial requirements relating to the selling of cooking appliances, the outer burner head may be surrounded at the bottom by a downwardly inclined, peripheral skirt and said peripheral skirt is designed as a removable part.

Furthermore, to avoid increasing the number of accessories needed to operate the burner and thereby reduce the overall cost of the burner, the burner has a thermocouple to detect the presence of flames and/or an electric ignition member and said thermocouple and/or ignition member co-operate with the central burner.

Due to its structure, a burner designed as proposed by the invention is very flexible with regard to the type of cooking appliance on which it can be mounted. Either the outer burner head may be provided with a single gas ring disposed towards either the interior or exterior, depending on the circumstances, or may be provided with two rings, an inner and an outer one. Alternatively, the central and outer burners may, depending on the circumstances, be either connected to a common gas supply control or may each be connected to an individual gas supply control, which will enable flexible modulation of the heating conditions with regard to where and when the heat is applied.

BRIEF DESCRIPTION OF THE DRAWINGS

The invention will be more readily understood from the detailed description of certain embodiments below, given solely by way of illustration and not restrictive in any respect. Throughout the description, reference will be made to the appended drawings, of which.

DETAILED DESCRIPTION OF THE INVENTION

Figure 1:
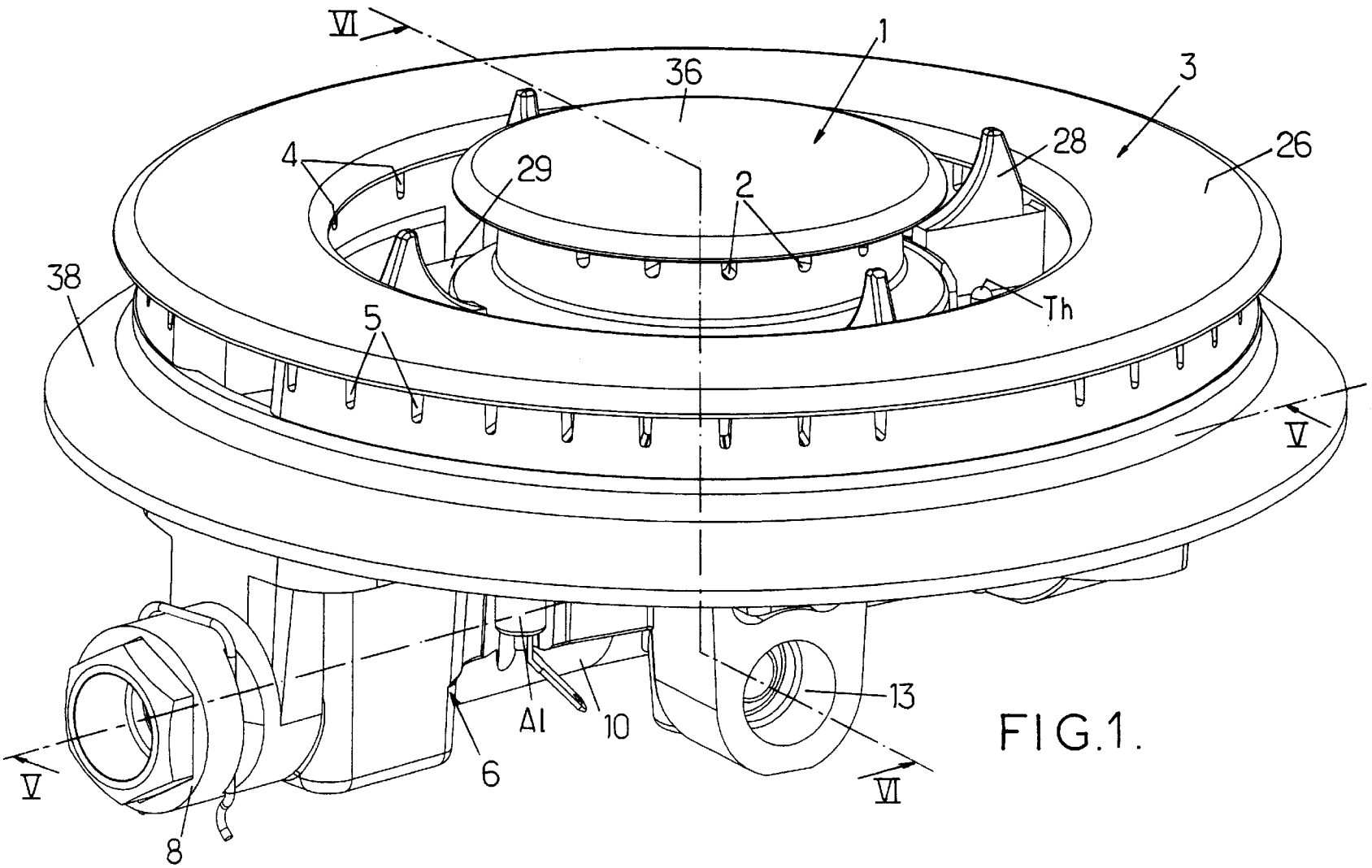
FIG. 1 is an overall, perspective view of a triple-ring burner as proposed by the invention.

Turning firstly to FIG. 1, the gas burner proposed by the invention has an inner burner head 1, which is in a central position, having a peripheral gas ring (flame passages 2) and at least one outer burner head 3, which is annular and surrounds the central burner head 1 at a distance therefrom, having at least one gas ring, inner and/or outer. In the example illustrated in these drawings, the annular, outer burner head 3 has two gas rings, one on the inside (flame passages 4) and the other outside (flame passages 5).

Figure 2:
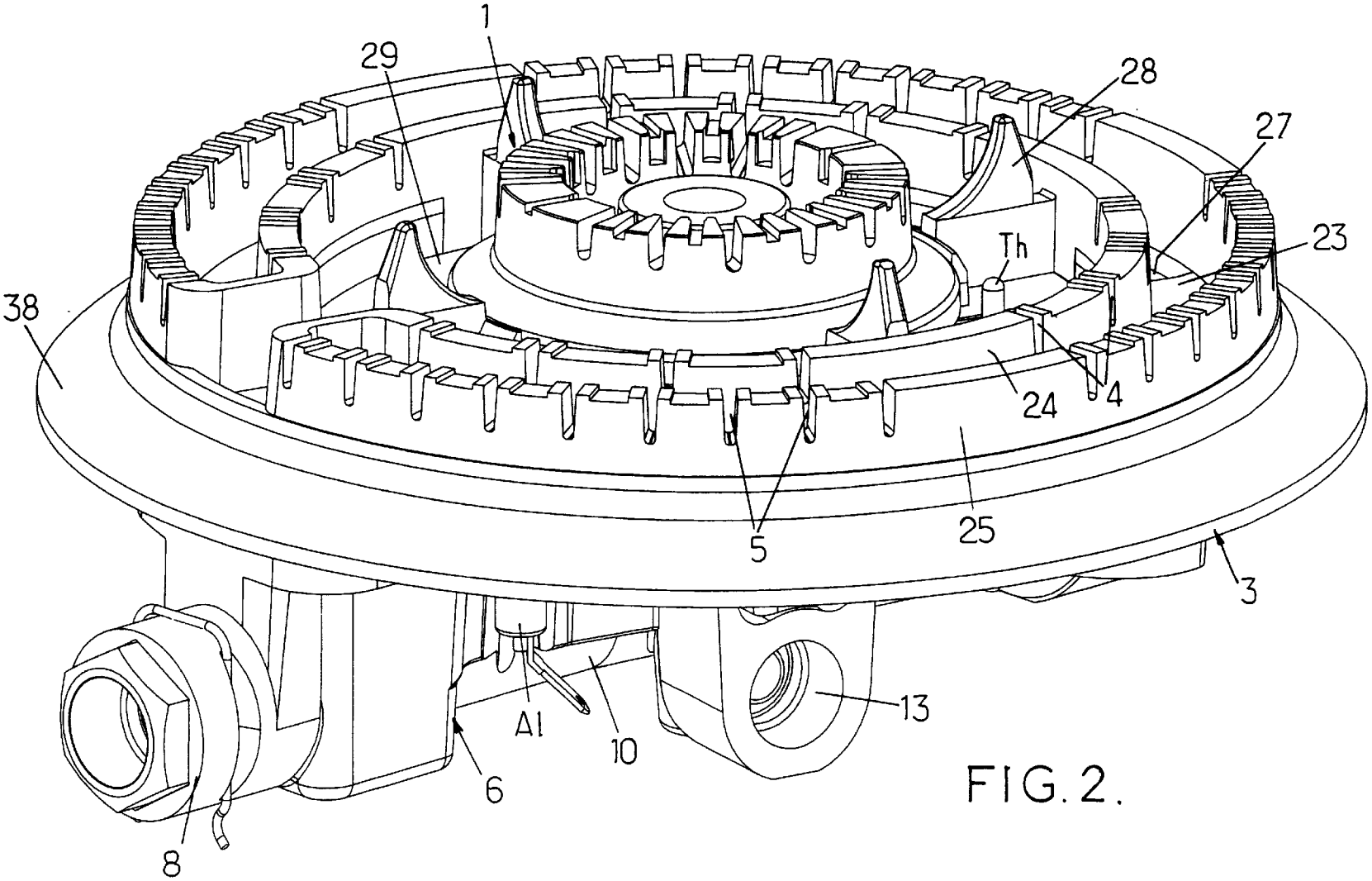
FIG. 2 is a perspective view, similar to that of FIG. 1 and showing the same burner in which the two cover have been removed.
Figure 3:
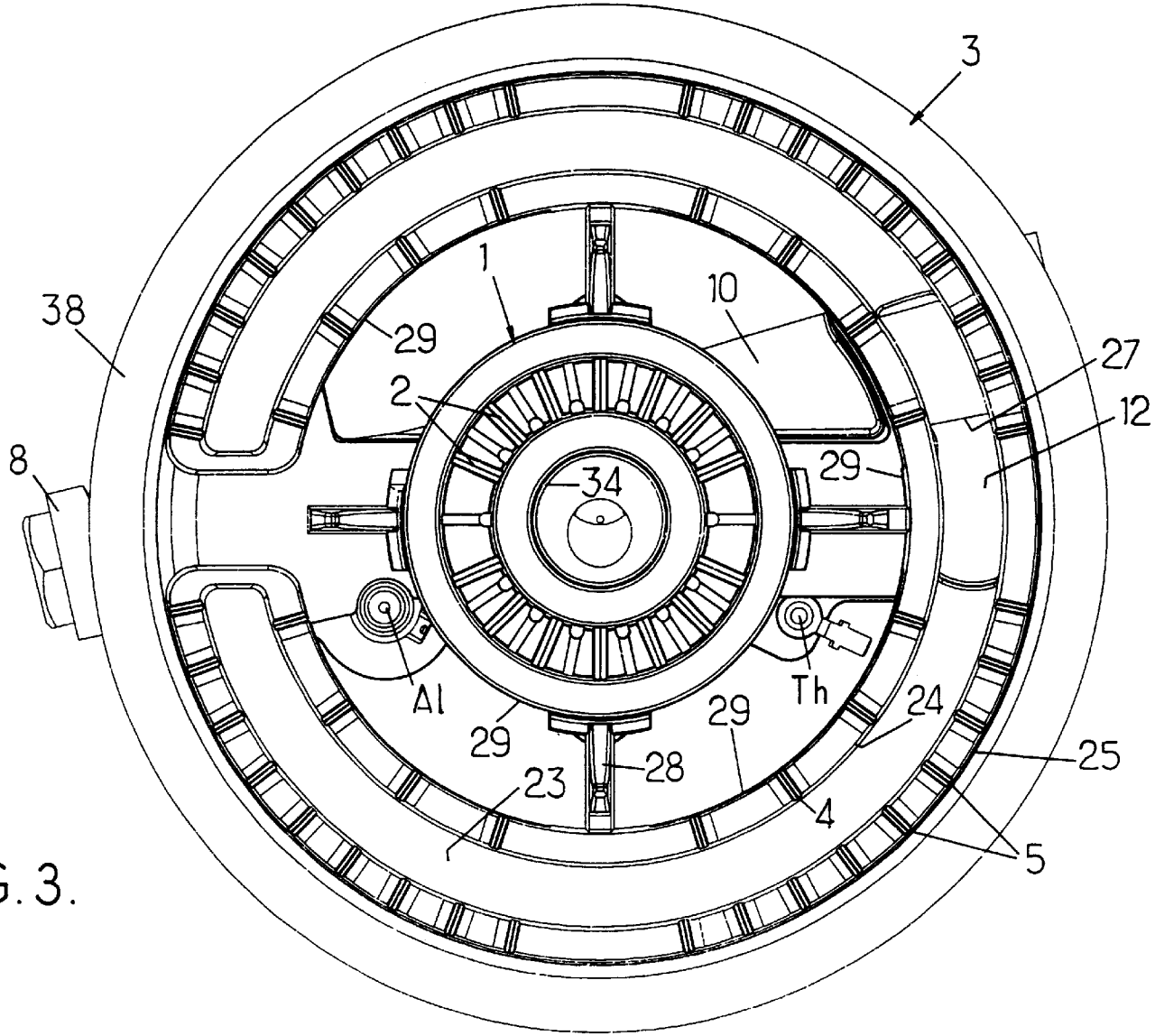
FIG. 3 is a plan view of the burner illustrated in FIG. 2, with the two covers removed.

The burner also has a burner body 6, which is partially visible in FIGS. 1 and 2 and illustrated separately in FIG. 3. The burner body shown here is of a relatively elongate shape, substantially corresponding to the diameter of the outer burner head 3 surmounting said body.

Figure 5:
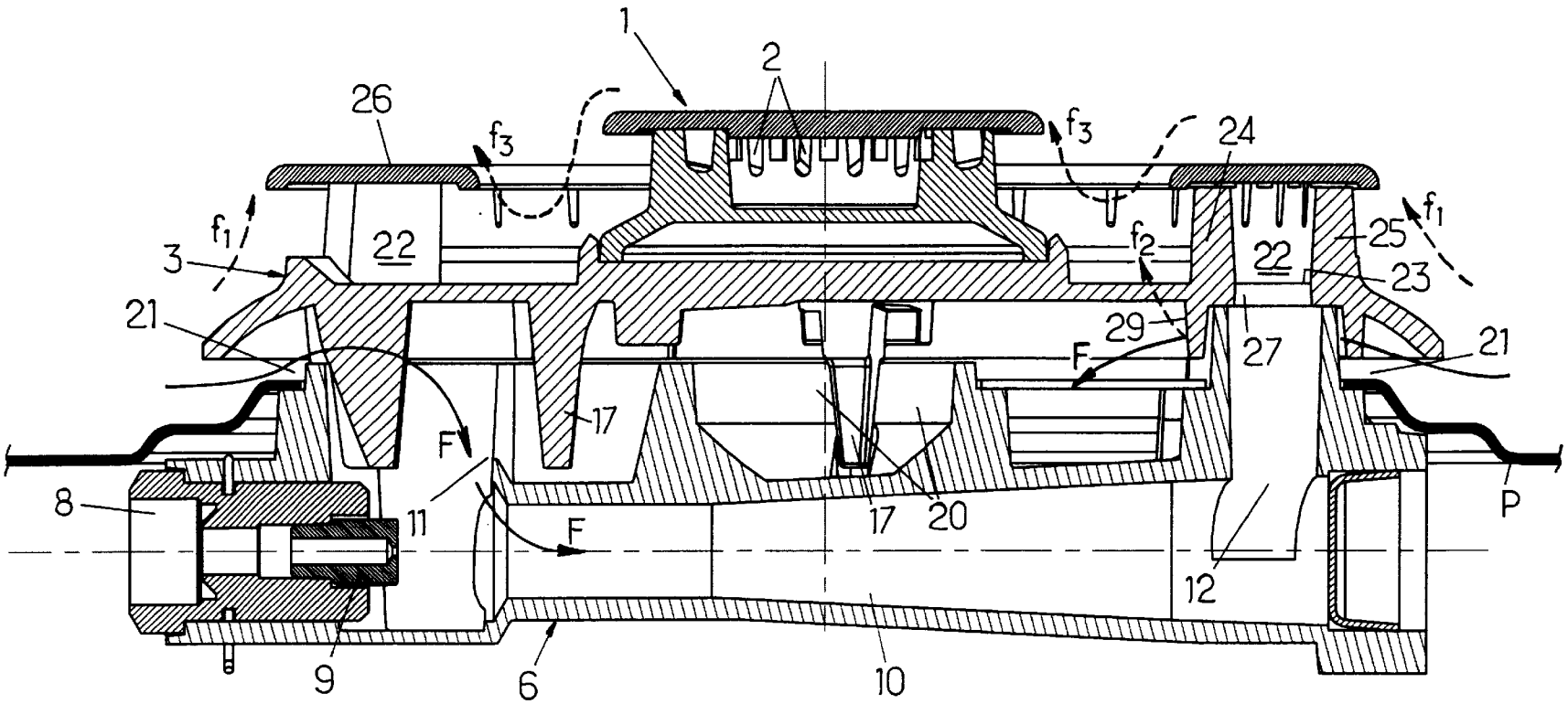
FIG. 5 is a schematic view of the burner of FIG. 1, shown in section along the line V—V.
Figure 6:
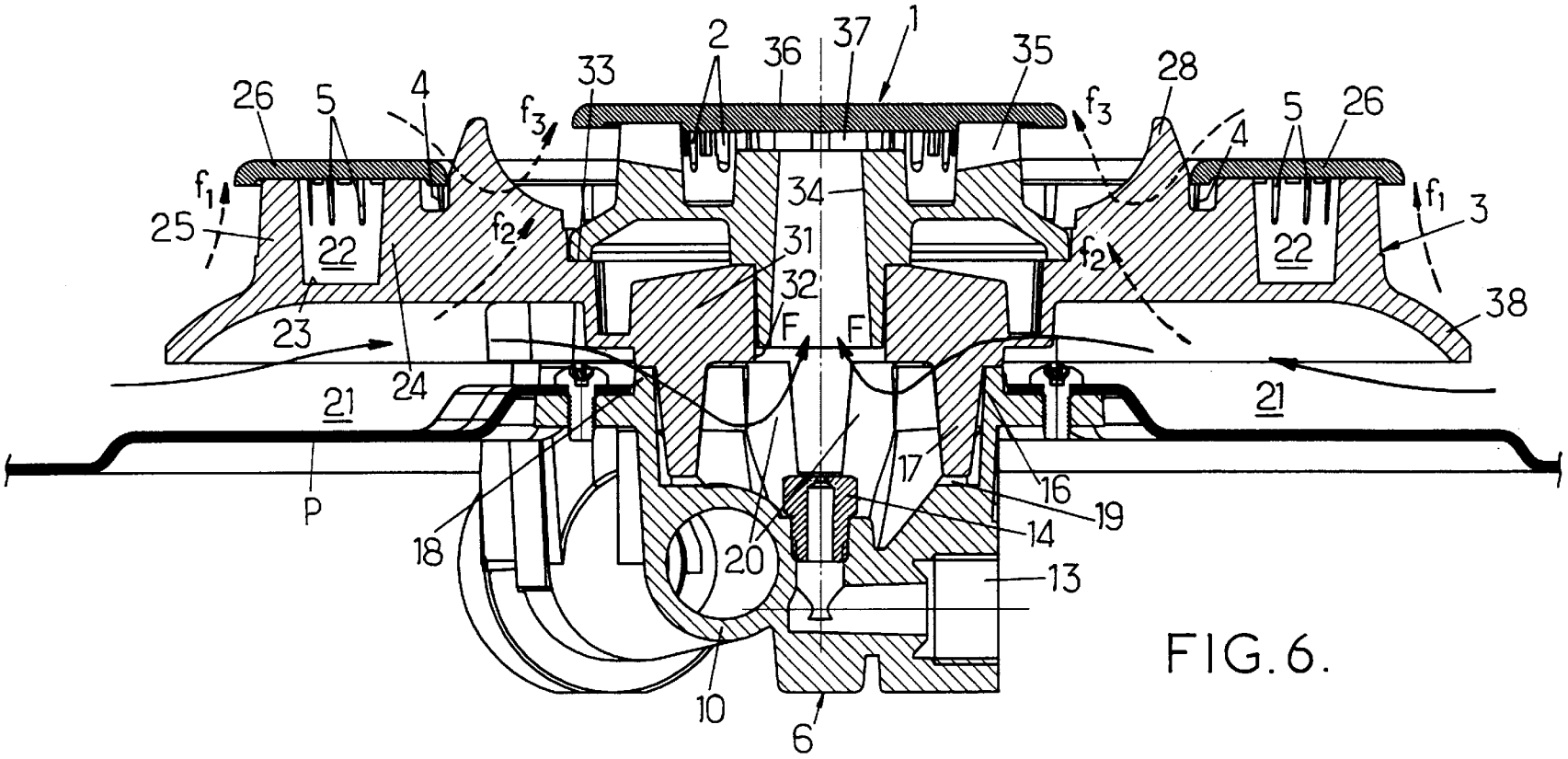
FIGS. 6 and 7 are schematic views of two embodiments, respectively, of the burner of FIG. 1, in section along the line VI—VI.
Figure 7:
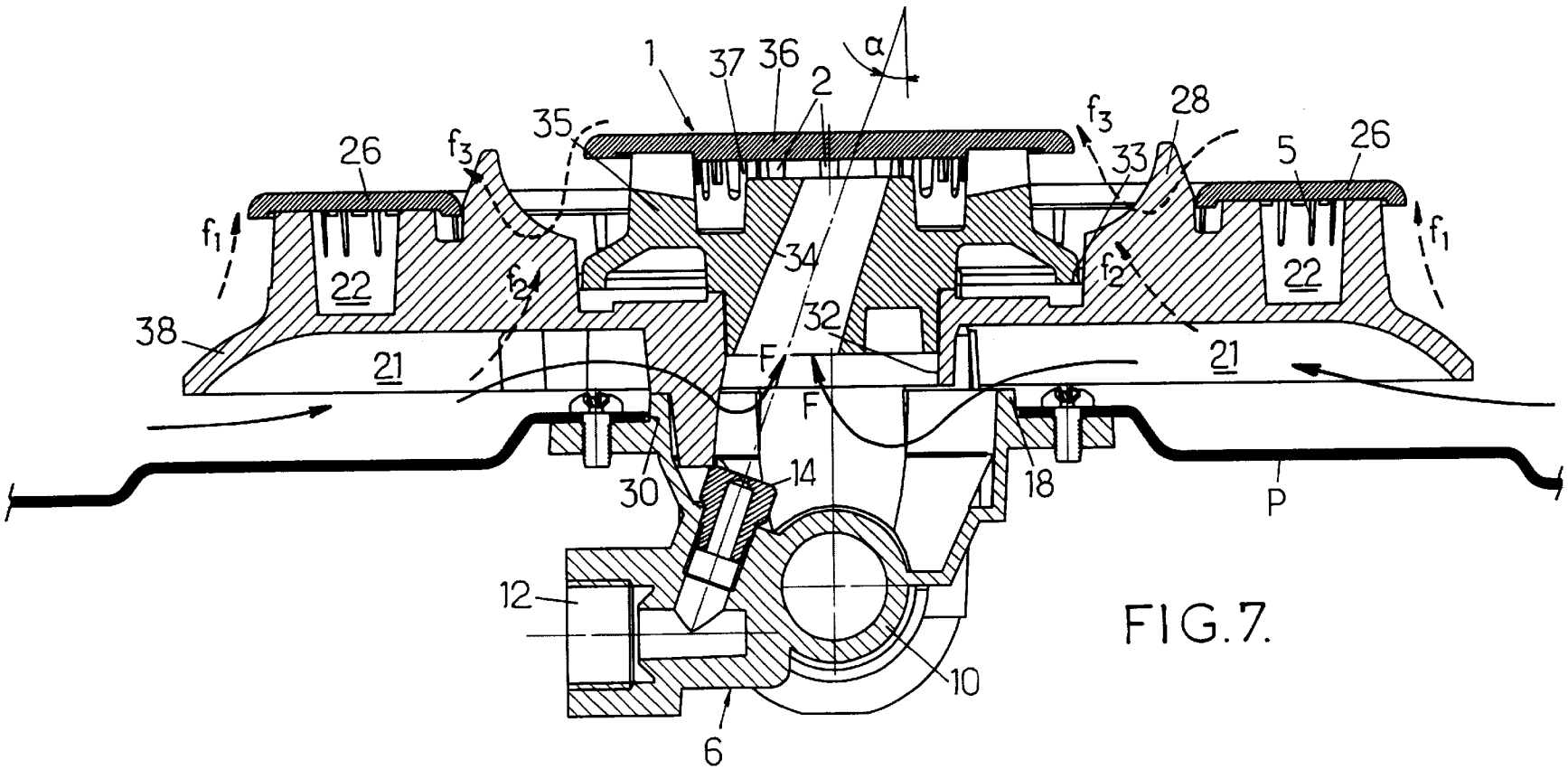

The burner body 6 is designed so that it can be secured by fixing means 7 underneath the top plate of a cooking appliance, such as a cooker, which top plate P can be seen in the drawings showing cross-sections in FIGS. 5, 6 and 7.

Located at one end of the burner body 6 is a first gas inlet 8, which can be connected to a gas supply by control means (not illustrated) which are preferably designed specifically for it.

As may be seen from FIG. 5, the gas inlet 8 communicates with a coaxially disposed gas injector 9 facing an end of a pipe 10, which is initially convergent and then divergent forming a tubular Venturi, extending substantially across the greater part of the length of the outer burner body 6, i.e. the diameter of the outer burner head 3. An intake port 11 for primary air is provided between the gas injector 9 and the pipe 10. At its terminal end, the pipe 10 connects with a substantially vertical well 12 feeding the air-gas mixture into the annular, outer burner head 3.

Figure 4:
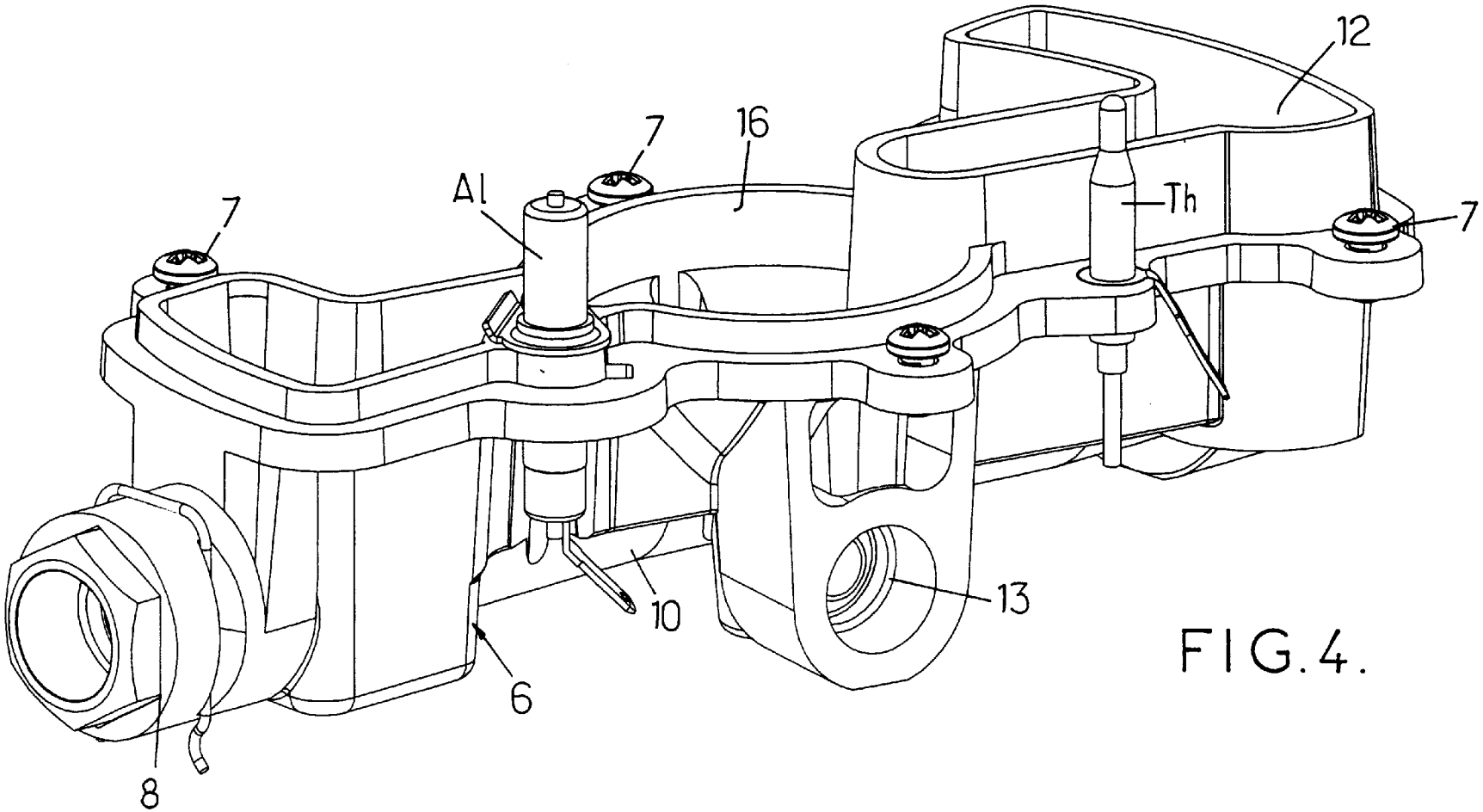
FIG. 4 is a perspective view of the burner body only.

As may be seen more readily from FIGS. 4 and 6, the burner body has a second gas inlet 13, separate from the first inlet 8 mentioned above and disposed, in this case, on the side of the body 6. The gas inlet 13 can be connected to a gas supply by control means (not illustrated), preferably designed specially for it and separate from the supply control means of the first gas inlet 8.

The gas inlet 13 communicates with a gas injector 14, which is directed upwards: in FIG. 6, the axis of the injector 14 is substantially vertical and substantially coaxial with the inner 1 and outer 3 burner heads.

As may be seen more readily from FIG. 4, the burner body 5 supports the accessories needed for the burner to operate safely and in particular at least one thermocouple Th and at least one electric ignition member Al.

The outer burner head 3 sits, through a cut-out 30 provided in the top plate P, on the burner body 6 assisted by support means. To this end, as may be more readily seen from FIGS. 4 and 6, the burner body 6 may be provided with support collar 16 which is circular overall, disposed centrally and coaxially with the vertical injector 14. In conjunction with the central base of the burner body 6, this collar 16 forms a basin so to speak, with the injector 14 at its centre and the support means of the outer burner head disposed laterally. In the example illustrated here, the support means are integral with the bottom of the outer burner head 3 and are provided in the form of a skirt 17 projecting downwards forming a peripheral shoulder 18 on the exterior, supported on the top of the above-mentioned collar 16. This skirt 17 is made either in a continuous design having ports or discontinuously (as illustrated in FIG. 6) in order to provide passages 20 for the primary air, as will be explained below.

It may also be seen that the bottom edge of the skirt 17 is designed to co-operate with projections 19 provided in the base of the basin to prevent the outer burner head 3 from rotating on the burner body 6 and simultaneously as a means of mutually positioning them at the correct angle.

As may be seen more clearly from FIGS. 4 and 5, the part of the outer burner head 3 surrounding the central region provided with the projecting skirt 17 overhangs the top plate P, being retained at a distance above the latter, so that the top plate P and the bottom face of the burner head 3 define an annular space 21 between them, which is irregular in shape relative to the general contour of the burner. Said passages 20 communicate with this space 21.

The outer burner head 3 has an annular chamber 22 located in the vicinity of the outer periphery of this head. The chamber 22 is formed by a passage defined by a base 23 and two concentric lateral walls 24, 25 and an annular cover or cap 26 capping said passage. Notches are provided in at least one of the walls 24, 25 forming passages for flames. In the example illustrated here, the two walls 24, 25 are provided with respective notches 4, 5, so that the outer burner head has a double gas ring.

The assembly as a whole is also clearly visible in FIGS. 2 and 3.

As may be seen from FIGS. 2 and 6, the base 23 has an opening 27 facing the above-mentioned substantially vertical well 11.

As may be seen from FIGS. 1, 2 and 6 in particular, the annular cover 26 is guided during fitting and retained in position by locating fingers 28 integral with the outer burner head 3.

As may be seen from FIGS. 3 and 5, the outer burner head 3 is designed to have, between a central region that will be explained below and the annular chamber 22, ports 29 opening into this intermediate annular zone, the purpose of which is to allow air to circulate as will become clear later on.

Finally, the central region 31 of the outer burner head 3 has a substantially vertical recess 32, coaxial with the axis of the injector 14.

The central burner head 1 is supported peripherally on an annular shoulder 33 provided in the outer burner head 3. Its central region, projecting downwards, is located in said recess 32 of the outer burner head and has a central well 34 coaxial with the axis of the injector 14. The well 34 has a cross section which decreases towards the top and forms a convergent.

The peripheral wall 35 of the central burner head 1 has indentations 2 cut into it, forming passages for flames. A cap or cover 36 sits on the wall 35.

The faces opposite the cover 36 and the central region of the central burner head 1 which surround the orifice of the well 34 substantially diverge from one another radially towards the exterior forming a radial, annular divergent 37. The unit comprising the tubular convergent 34 and the radial annular divergent 37 form a Venturi.

FIG. 7 illustrates a different embodiment of the layout illustrated in FIG. 6 and in which the central well 34 and the injector 14, which are coaxial, are not vertical but inclined at an angle of 15 to 20° relative to the vertical. This layout is preferred over the mounting on a vertical axis illustrated in FIG. 6 because it produces a longer well 34: although slight, this extra length is enough to improve the efficiency of the central burner 1.

Figure 8:
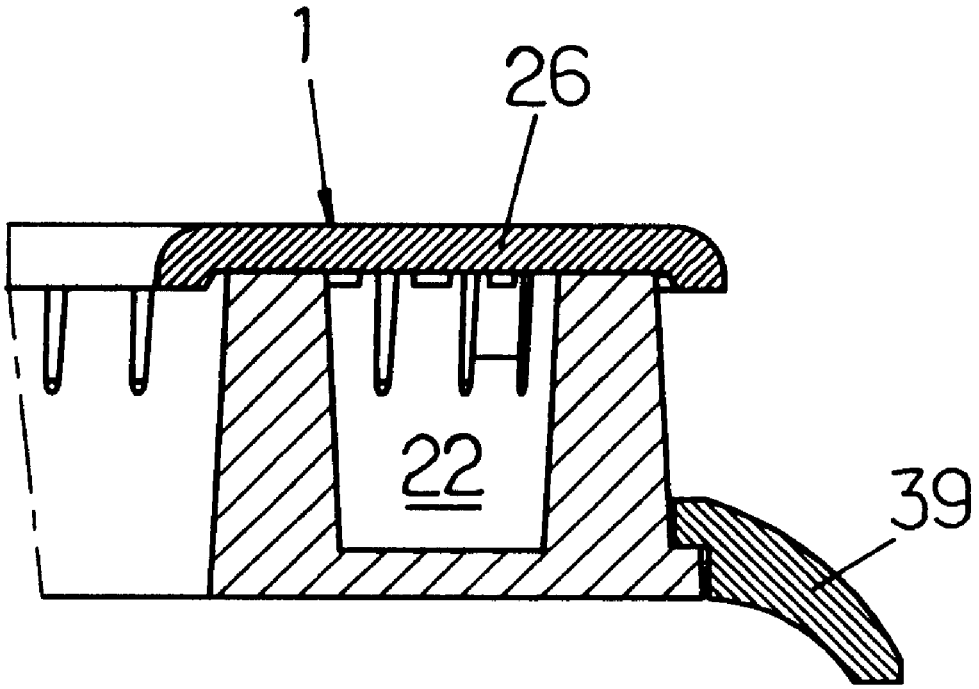
FIG. 8 is a partial schematic view, in section, illustrating another embodiment of a part of the burner proposed by the invention.

Finally, it may be noted that the outer burner head 3, as is often the gas with gas burners, is bounded at the bottom by a downwardly inclined, peripheral annular skirt 38. This skirt may be an integral part of the burner head 3, as is particularly evident in FIGS. 5, 6 and 7, or may be an annular part 39 which removably fits on the burner head 3: this annular part 39 may be set in place by means of appropriate shoulders as illustrated in partial section in FIG. 8. Furthermore, this annular part can easily be shaped and/or decorated in various ways to meet sales requirements, for example.

The structural features described above provide a multi-ring gas burner in which all the air, primary and secondary, needed for its operation is provided from above the top plate P, which avoids the disadvantage (flames blowing out) inherent in a partial or total supply of primary air from underneath the plate P.

In the drawings in section shown in FIGS. 5, 6 and 7, the solid arrows F indicate the path of the primary air which, from the annular space 21, arrives at the inlet of the pipe 10 (FIG. 5) and simultaneously passes through the orifices 20 to arrive on a level with the injector 14 (FIGS. 6 and 7).

The paths taken by the secondary air, which has to reach the base of the flames, are diagrammatically indicated by the arrows in broken lines f. It is drawn partially from outside the burner (arrows $f_1$) for the outer gas ring, and from a fraction of the air in the annular space 21 and rising through the ports 29 (arrows $f_2$) and outside air arriving via the top (arrows $f_3$) for the two facing inner gas rings.

Finally, it should be pointed out that in order to simplify the structure of the burner and keep its cost down, a single thermocouple Th and/or a single electric ignition member Al are provided, which then necessarily co-operate with the single central burner.

What is claimed is:

1. A gas burner with multiple gas rings designed to be mounted on a top plate of a cooking appliance comprising:

a central burner having a ring for peripheral flames;

at least one annular burner having at least one gas ring surrounding the central burner at a certain distance therefrom;

a burner body designed to be fixed to a bottom surface of the top plate, said burner body having a first gas inlet communicating with a first gas injector, an axis of which is upwardly directed, and a second gas inlet communicating with a second gas injector having a substantially horizontal axis and disposed facing a convergent-divergent pipe forming a venturi, extending across a greater part of a transverse extension of the burner body, said pipe communicating at an end opposite the second injector with a substantially vertical well having an open top;

an outer burner head supported by support means inserted in a cut-out section of said top plate, by said burner body, said burner head having a substantially annular chamber provided with passages for flames at least around one side and a base having an opening which faces said substantially vertical well of the burner body, a central region having a central, vertical recess, and ports disposed between said annular chamber and said central region, such that said support means for the outer burner head is designed so that said burner head is disposed above and at a distance from the top plate, forming in conjunction therewith an annular space surrounding said central region, said support means having lateral recesses providing a communication between said central recess of the central region and said annular space and;

an inner burner head centrally supported by said outer burner head facing said central recess of the central region, said inner burner head having a central well coaxially aligned with the axis of said first gas injector, such that all primary air needed to operate the central burner and the annular burner is delivered to the first and second gas injectors exclusively from above the top plate, and secondary air needed for the multiple gas rings is delivered to a bottom portion of the flames exclusively from above the top plate.

2. The gas burner as claimed in claim 1, wherein the central well of the inner burner head is directed substantially vertically, and wherein the first injector has a substantially vertical axis.

3. The gas burner as claimed in claim 1, wherein the central well of the inner gas burner and the first injector substantially coaxial therewith are inclined at approximately 15 to 20° relative to the vertical axis.

4. The gas burner as claimed in claim 1, wherein the outer burner head has a single annular chamber and is provided bilaterally with passages for flames, and wherein the annular burner has two gas rings, the burner being of the type with three gas rings.

5. The gas burner as claimed in claim 1, wherein the support means of the outer burner head are integral with said outer burner head and are provided in the general form of a skirt projecting down below the bottom of said head and a shoulder surrounding the central recess of the central region of said burner head.

6. The gas burner as claimed in claim 1, wherein the annular chamber of the outer burner head is closed at the top by a removable annular cover placed on the lateral walls of the chamber.

7. The gas burner as claimed in claim 1, wherein the central well of the inner burner head has a section decreasing in the upward direction, thereby forming a first, tubular venturi section, and wherein the upper surface of the inner burner head surrounding the top orifice of the central well defines, in conjunction with a surmounting removable cover, a radial, annular divergent forming a second, radial annular venturi section.

8. The gas burner as claimed in claim 1, wherein the outer burner head is surrounded at the bottom by a downwardly inclined removable peripheral skirt.

9. The gas burner as claimed in claim 1, including a thermocouple for detecting the presence of flames and an electric ignition member, and wherein said thermocouple and said ignition member co-operate with the central burner.

* * * * *